US008746167B2

(12) United States Patent
Walter et al.

(10) Patent No.: US 8,746,167 B2
(45) Date of Patent: Jun. 10, 2014

(54) COATING PRODUCT SPRAYGUN AND METHOD FOR RESUPPLYING COATING PRODUCT TO SUCH A SPRAYGUN

(75) Inventors: Hervé Walter, Saint Bernard du Touvet (FR); Denis Vanzetto, Echirolles (FR); Franck Gerstch, Meylan (FR)

(73) Assignee: Sames Technologies, Meylan (FR)

( * ) Notice: Subject to any disclaimer, the term of this patent is extended or adjusted under 35 U.S.C. 154(b) by 159 days.

(21) Appl. No.: 13/133,216

(22) PCT Filed: Dec. 8, 2009

(86) PCT No.: PCT/FR2009/052452

§ 371 (c)(1),
(2), (4) Date: Jul. 28, 2011

(87) PCT Pub. No.: WO2010/067014

PCT Pub. Date: Jun. 17, 2010

(65) Prior Publication Data

US 2011/0277686 A1 Nov. 17, 2011

(30) Foreign Application Priority Data

Dec. 9, 2008 (FR) ..... 08 58414

(51) Int. Cl.
*B05B 3/00* (2006.01)

(52) U.S. Cl.
USPC ..... 118/323; 118/321; 239/223; 901/43

(58) Field of Classification Search
USPC ..... 118/300, 321, 323; 239/223, 224; 901/43, 45, 21, 27, 41; 427/427.2, 427/427.3
See application file for complete search history.

(56) References Cited

U.S. PATENT DOCUMENTS

| | | | | |
|---|---|---|---|---|
| 4,779,804 | A | 10/1988 | Baba et al. | |
| 5,310,120 | A * | 5/1994 | Ehinger et al. | 239/708 |
| 5,413,283 | A | 5/1995 | Gimple et al. | |
| 5,899,387 | A * | 5/1999 | Haruch | 239/296 |
| 6,582,766 | B2 * | 6/2003 | Yamada et al. | 427/261 |
| 6,702,893 | B2 * | 3/2004 | Thome et al. | 118/302 |
| 6,902,758 | B2 * | 6/2005 | Donatti et al. | 427/133 |
| 7,250,194 | B2 * | 7/2007 | Aversenti et al. | 427/455 |
| 2003/0157261 | A1 | 8/2003 | Ballu | |

FOREIGN PATENT DOCUMENTS

| | | |
|---|---|---|
| EP | 0587467 A | 3/1994 |
| EP | 0851128 A | 7/1998 |
| EP | 1 071 518 B1 | 9/2004 |

(Continued)

OTHER PUBLICATIONS

International Search Report for PCT/FR2009/052452; Dated Feb. 18, 2010.

(Continued)

*Primary Examiner* — Yewebdar Tadesse
(74) *Attorney, Agent, or Firm* — Husch Blackwell LLP; Robert M. Gould

(57) ABSTRACT

This spraygun (1) comprises a body (11) and, housed in a proximal part (11.1) of the body (11), a tank (10) extending along a main axis ($X_{10}$). This spraygun also comprises atomizing means (5) in a distal part (11.2) of the body (11) comprising an atomizing member (51) designed to atomize the coating product generally in an atomizing direction ($Y_{50}$). The atomizing direction ($Y_{50}$) and the main axis ($X_{10}$) of the tank are convergent.

16 Claims, 2 Drawing Sheets

(56) References Cited

FOREIGN PATENT DOCUMENTS

Figure 1:
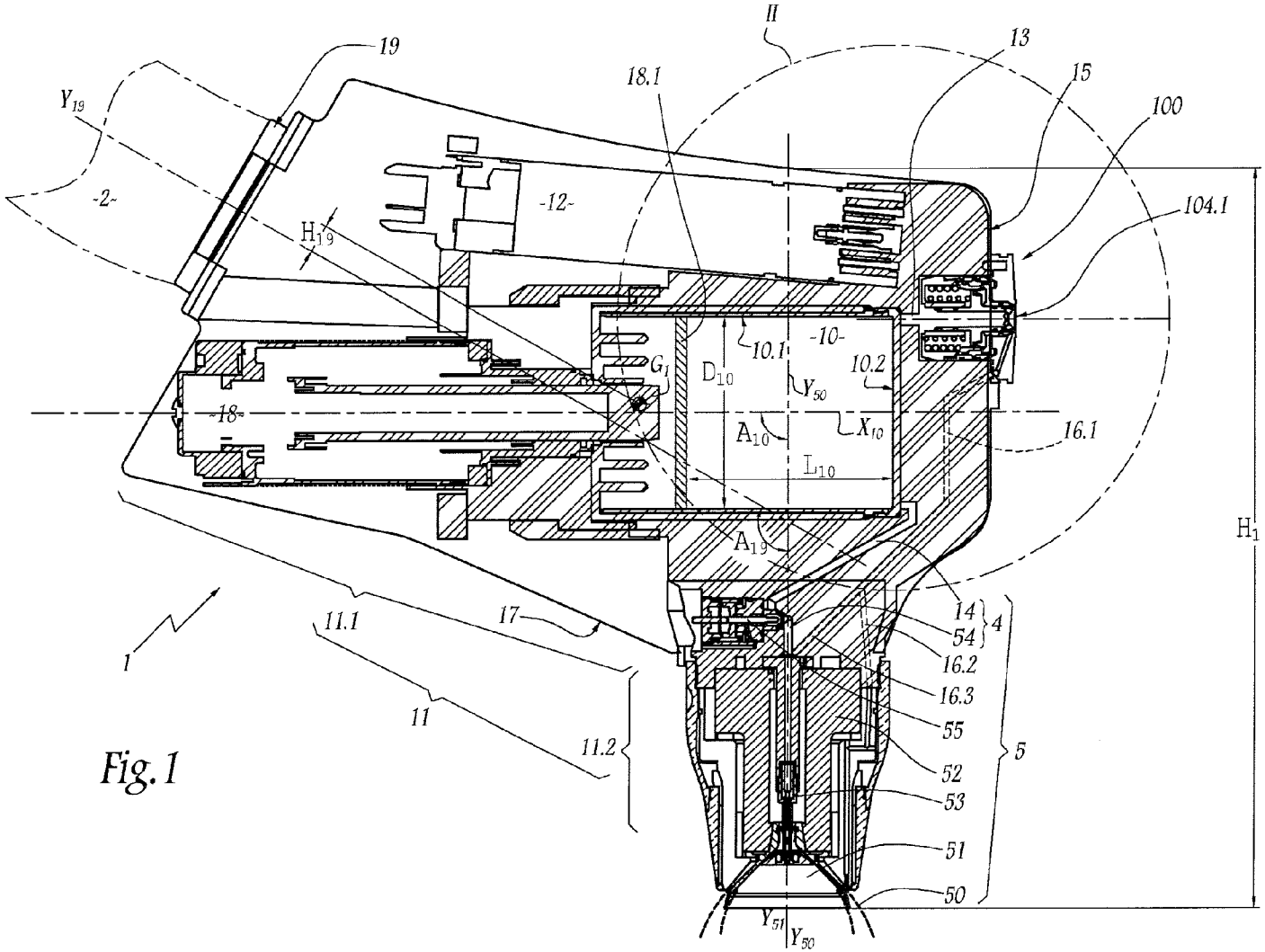

| | | | |
|---|---|---|---|
| FR | 2777482 | A | 10/1999 |
| FR | 2887474 | A | 12/2006 |
| JP | 5-3233 | Y2 | 1/1993 |
| JP | 2005-521544 | | 7/2005 |
| JP | 2008119654 | A | 5/2008 |
| WO | 02092236 | A | 11/2002 |
| WO | 03045574 | A | 6/2003 |

OTHER PUBLICATIONS

Hager J S et al.; "Electrostatic Application of Waterborne Paint" Automotive Engineering, Society of Automotive Engineers, Warrendale, US vol. 105, No. 6, Jun. 1, 1997; pp. 41-42; XP000655270.

* cited by examiner

COATING PRODUCT SPRAYGUN AND METHOD FOR RESUPPLYING COATING PRODUCT TO SUCH A SPRAYGUN

RELATED APPLICATIONS

The present application is a §371 U.S. national stage entry of International Application No. PCT/FR2009/052452, filed Dec. 8, 2009, which claims the priority of France patent application No. 08 58414 filed Dec. 9, 2008, all of which are incorporated herein by reference in their entirety.

FIELD

The present invention relates to an atomizer that is designed to be moved by a robot for the purposes of spraying a coating material towards articles to be coated. The present invention also relates to a method of re-supplying such an atomizer with coating material. The term "coating material" is used to designate a liquid material such as a primer, a paint, or a varnish.

BACKGROUND

FR-A-2 887 474 describes an atomizer comprising a body fastened to the wrist of a multi-axis robot that moves the atomizer relative to the articles to be coated. The articles to be coated in that document are vehicle bodies conveyed by a conveyor. That atomizer also has a coating material reservoir that is housed in a proximal portion of the body. The reservoir has a cylindrical shape that extends along a main axis that coincides with the axis of the atomizer. A turbine and an atomizer member in the form of a bell cup are mounted in the body. As shown by comparing FIGS. 1 and 2 of FR-A-2 887 474, the atomizer member sprays the coating material substantially in a spraying direction that extends the main axis of the atomizer and of its reservoir. In other words, the main axis of the reservoir is co-linear with the spraying direction.

The atomizer thus has an elongate shape that limits its agility, i.e. its aptitude for reaching regions that are difficult to access, in particular, on the inside of a motor vehicle body.

In addition, the length and the narrowness of the connection duct and of the feed duct generate large head losses that can reduce the flow rate of solvent, and thus slow down cleaning operations. A specific low head loss duct is necessary for collecting waste when cleaning the atomizer. Thus, in a conventional paint spraying installation, a cleaning stage lasts about 20 seconds (s) and gives rises to paint losses of about 25 cubic centimeters ($cm^3$).

A particular object of the present invention is to remedy those drawbacks, by proposing an atomizer that is agile, compact, and simple to manipulate, by means of a robot.

SUMMARY

To this end, the invention provides an atomizer for spraying a coating material towards articles to be coated, which atomizer comprises:

- a body equipped with a flange for fastening the atomizer to a robot, the robot and/or the flange defining a terminal axis about which the atomizer is designed to move relative to the articles to be coated;
- a coating material reservoir housed in a proximal portion of the body and extending along a main axis; and
- atomizer means for spraying the coating material, which means are disposed in a distal portion of the body, the atomizer means having an atomizer member arranged to spray the coating material substantially in a spraying direction.

This atomizer is characterized in that the spraying direction and the main axis of the reservoir are convergent.

By means of the invention, the reservoir housed in the body is offset angularly relative to the spraying direction, thereby facilitating spraying in cavities, and cleaning/filling the reservoir.

According to other advantageous but optional characteristics of the invention, taken in isolation or in any technically feasible combination:

- the angle between the main axis of the reservoir and the spraying direction lies in the range 50° to 100°, and is preferably equal to 90°;
- the terminal axis forms an angle with the spraying direction that lies in the range 110° to 130°, and that is preferably equal to 120°;
- the distance between the center of gravity of the atomizer and the terminal axis is selected to be less than 80 millimeters (mm), and preferably to be less than 20 mm;
- the height of the atomizer, as measured in the spraying direction is selected to be less than 450 mm, and preferably less than 400 mm;
- the atomizer has at least one orifice for connection to a coating material circuit, said orifice being situated on the outside surface of the atomizer, and it has a connection duct connecting the orifice to the reservoir, the connection duct having a length less than or equal to 50 mm;
- the atomizer also has a valve for controlling the flow of coating material and of a cleaning material through the atomizer, the valve forming a portion of the connection duct;
- the atomizer means have a feed duct for feeding the atomizer member, the feed duct extending from the reservoir to the atomizer member, the feed duct having a length less than or equal to 300 mm, and a maximum diameter less than or equal to 5 mm, and preferably less than or equal to 4 mm;
- the reservoir has a piston for pushing the coating material towards the atomizer means, and the atomizer also has an actuator for moving the piston along the main axis, the actuator being housed in the body between the reservoir and the flange;
- the reservoir is in the shape of a cylinder having a circular base and of volume lying in the range 200 $cm^3$ to 1000 $cm^3$, and the diameter of the cylinder of the reservoir lies in the range 50 mm to 120 mm, and is preferably equal to 100 mm; and
- the atomizer means have rotary drive means for driving the atomizer member in rotation about an axis of rotation that substantially coincides with the spraying direction.

The invention also provides a method of re-supplying an atomizer as defined above with coating material, said method being characterized in that it comprises the following steps:

a) dumping all of any coating material remaining in the reservoir through the feed duct and through the atomizer member;

b) opening the valve to cause cleaning material to flow into the reservoir and into a cleaning duct, all of the cleaning material flowing, downstream from the reservoir, through the atomizer member; and c) opening the valve to cause the coating material to flow into the connection duct and into a cleaning duct in such a manner as to fill the reservoir with the new coating material.

The invention can be well understood and its advantages also appear from the following description, given merely by way of non-limiting example and with reference to the accompanying drawings, in which:

FIGURES

Figure 2:
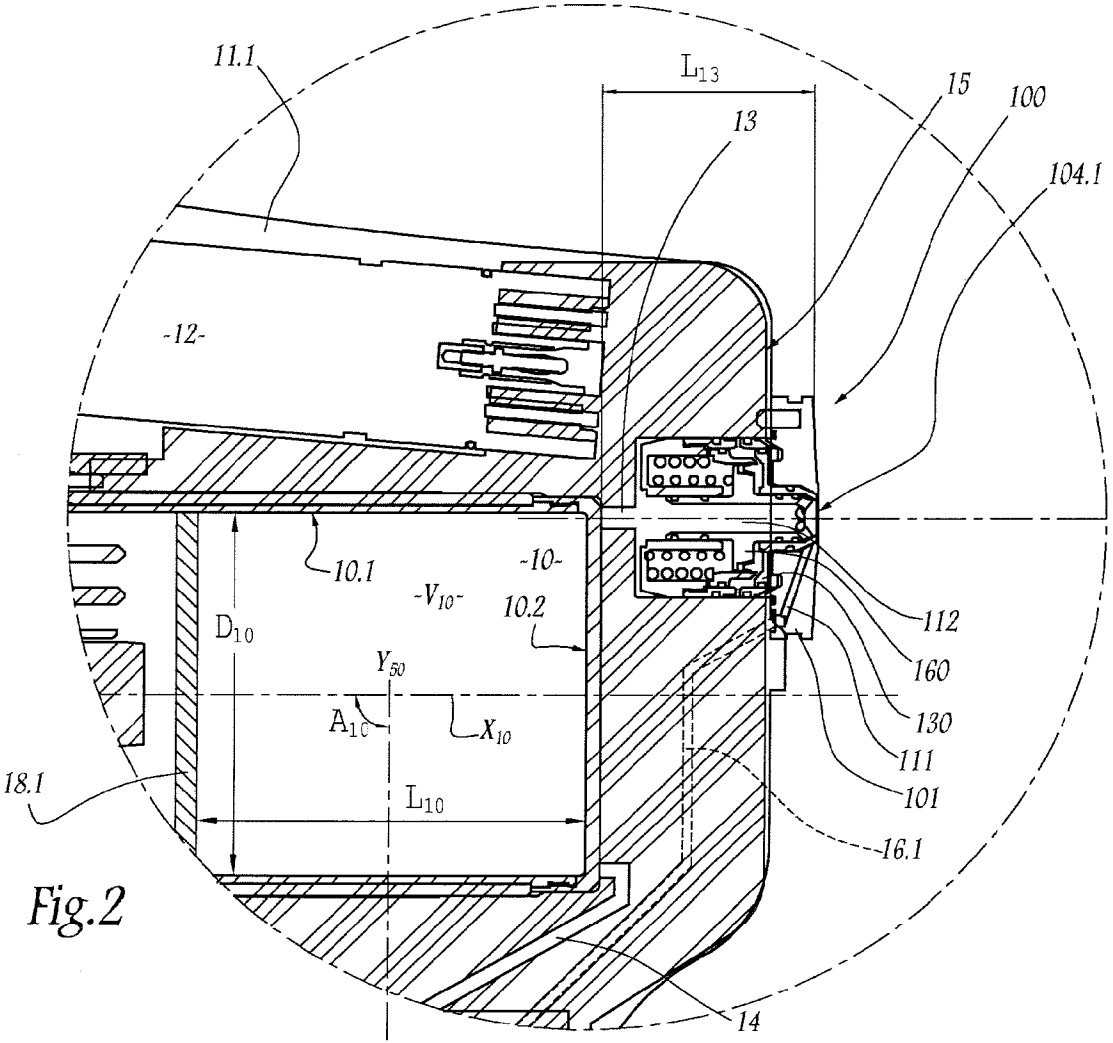

FIG. 1 is a section view of an atomizer of the invention; and FIG. 2 is a view on a larger scale of the detail II of FIG. 1.

DETAILED DESCRIPTION

FIG. 1 shows an atomizer 1 including a body 11, a reservoir 10, and atomizer means 5. The atomizer 1 is designed to spray a liquid material, such as a paint, a primer, or a varnish, towards articles to be coated, such as vehicle bodies. The function of the reservoir 10 is to contain the material to be sprayed.

The body 11 is equipped with means for fastening to a robot 2 of the multi-axis type. The casing of the robot 2 is shown in chain-dotted lines in FIG. 1. The robot 2 is designed to move the atomizer 1 relative to the articles to be coated. In order to mount the atomizer 1 on the robot 2, the body 11 is equipped with a flange 19, which is collar-shaped in this example. The means for fastening the atomizer 1 to the robot 2 comprise a set of screws in abutment against the flange 19. The flange 19 is at the interface between the robot 2 and the atomizer 1. In practice, the flange can have various shapes, so long as it makes it possible to link the body to the robot, thereby performing the function of base for the atomizer.

The flange 19 defines a terminal axis $Y_{19}$ about which the atomizer 1 moves relative to the articles to be coated. The terminal axis $Y_{19}$ is referred to as being "terminal" because it coincides with the last axis of the robot 2 before the atomizer 1 itself. When the robot 2 is a multi-axis robot, said robot 2 has at least six axes for moving the atomizer 1, including the terminal axis $Y_{19}$. In the embodiment shown in FIGS. 1 and 2, the terminal axis $Y_{19}$ is thus defined by the flange 19 and by the robot 2. Alternatively the terminal axis may be defined by the robot only, and not by the flange.

The body 11 is made up of a proximal portion 11.1 and of a distal portion 11.2. The reservoir 10 is received in the proximal portion 11.1, i.e. it is incorporated into the volume defined by a casing 17 of the body 11. In the present patent application, the adjectives "proximal" and "distal" are used with reference to the flange 19. The adjective "proximal" designates an element relatively close to the flange 19, whereas the adjective "distal" designates an element that is further away therefrom.

The reservoir 10 is in the overall shape of a circular cylinder defined by a cylindrical surface 10.1 and by a circular base 10.2. The reservoir 10 extends along a main axis $X_{10}$ that is horizontal in FIG. 1. The volume $V_{10}$ indicated herein corresponds to the maximum volume of the reservoir 10. The reservoir 10 has a diameter $D_{10}$ of 100 mm and a length $L_{10}$ lying in the range 50 mm to 100 mm. The volume $V_{10}$ of the reservoir 10 is about 0.8 liters (l), i.e. about 800 $cm^3$. In practice, the diameter $D_{10}$ lies in the range 50 mm to 120 mm, and the volume $V_{10}$ lies in the range 200 $cm^3$ to 1000 $cm^3$.

A piston 18.1 in the shape of a disk is arranged in the reservoir 10 so as to expel the coating material therefrom towards atomizer means 5, as described in detail below. The piston 18.1 is mounted to move in translation along the axis $X_{10}$. The atomizer 1 further includes an actuator 18 for moving the piston 18.1 in translation along the main axis $X_{10}$. The actuator 18 may be constituted by an electric motor or by any other equivalent actuator. The actuator 18 is of shape that is elongate along the main axis $X_{10}$. The actuator 18 is received in the proximal portion 11.1 of the body 11, in a space that is defined firstly by the reservoir 10 and secondly by the flange 19.

The atomizer means 5 comprise a bell cup 51 that constitutes an atomizer member, and a turbine 52 that forms means for driving the bell cup 51 in rotation about the axis of rotation $Y_{51}$. The atomizer means 5 further comprise an injector 53 mounted in a central cavity of the turbine 52, a downstream portion 54 of a feed duct 4, and an atomizer valve 55 that controls the flow of fluids through the injector 53 and thus over the bell cup 51.

During paint spraying, the atomizer valve 55 opens the downstream portion 54 of the feed duct 4, thereby enabling paint to flow through the injector 53 and over the bell cup 51. The turbine 52 drives the bell cup 51 in rotation at high speed. As is known per se, the bell cup 51 atomizes the paint into fine droplets that thus form a spray 50. The spray 50 substantially follows the spraying direction $Y_{50}$ so as to reach the article to be coated. The bell cup 51 is arranged to spray the paint substantially in the spraying direction $Y_{50}$. Since the bell cup 51 is circularly symmetrical, the spray 50 is in the shape of a paraboloid or of a bullet that is circularly symmetrical about the spraying direction $Y_{50}$. The spraying direction $Y_{50}$ substantially coincides with the axis of rotation $Y_{51}$ of the bell cup 51.

The spraying means 5 are disposed in a distal portion 11.2 of the body 11. The distal portion 11.2 forms a casing that contains the atomizer means 5. The distal portion 11.2 projects relative to the proximal portion 11.1 at the location of the reservoir 10.

The main axis $X_{10}$ of the reservoir 10 is perpendicular to the spraying direction $Y_{50}$, i.e. it forms an angle $A_{10}$ of 90° with the spraying direction $Y_{50}$. In practice, the angle $A_{10}$ lies in the range 50° to 100°. The main axis $X_{10}$ and the spraying direction $Y_{50}$ are thus convergent.

In the present patent application, the adjective "convergent" designates two directions that are not co-linear, that do not coincide, and that are not parallel. In other words, when the main axis $X_{10}$ and the spraying direction $Y_{50}$ are co-planar, the adjective "convergent" indicates that they are also secant. When the main axis $X_{10}$ and the spraying direction $Y_{50}$ are not co-planar, the adjective "convergent" indicates that the orthogonal projection of the main axis $X_{10}$ in a plane parallel to the main axis $X_{10}$ and containing the spraying direction $Y_{50}$ is secant to the spraying direction $Y_{50}$.

In addition, the distal portion 11.2 extends substantially in the spraying direction $Y_{50}$. In projection in the plane of FIG. 1, the terminal axis $Y_{19}$ forms an angle $A_{19}$ of about 120° with the spraying direction $Y_{50}$. In practice, the angle $A_{19}$ lies in the range 110° to 130°. Such an angle $A_{19}$ imparts high compactness to the atomizer 1, and thus good agility to the robot 2.

As shown in FIG. 2, the atomizer 1 has an orifice 104.1 for connection to a paint circuit (not shown) that is part of a re-supply station. The orifice 104.1 is situated on the docking surface 15 of the distal portion 11.1. The paint and the solvent penetrate into the atomizer 1 via the orifice 104.1 respectively during the stage of filling the reservoir 10 and during the stage of cleaning the atomizer 1.

The atomizer 1 also includes a connection duct 13 connecting the orifice 104.1 to the reservoir 10 and, more precisely, to its base 10.2. The connection duct 13 extends in the distal portion 11.1 in a manner such as to be rectilinear and perpendicular to the base 10.2 and to the docking surface 15. The connection duct 13 has a length $L_{13}$, measured parallel to the main axis $X_{10}$. The length $L_{13}$ is about 50 mm. In practice, the length $L_{13}$ is less than or equal to 100 mm.

The connection duct 13 is formed in part of a valve 100 that controls the flow of paint and of solvent in the atomizer 1. More precisely, the second duct 112 defines the upstream portion of the connection duct 13.

The valve 100 has a body 101, a first duct 111, and a distinct second duct 112, in which body and in which ducts fluids can flow that are used during the stages of filling the reservoir 10, of spraying, and of cleaning, i.e. that are constituted by paint, solvent, and compressed air. The valve 100 also has a first needle 130 and a second needle 160, which needles serve to allow the fluids to flow or to prevent them from flowing. The body 101 houses the first needle 130 and the second needle 160. In addition, the first needle 130 defines a recess adapted to receive a substantial portion of the second needle 160.

In addition, in this example, the feed duct 4, made up of an upstream portion 14 and of a downstream portion 54, and extending from the base 10.2 of the reservoir 10 to the bell cup 51, has a length of about 260 mm, that needs to be minimized, and a maximum diameter of about 4 mm. In practice, the length of the feed duct 4 is less than or equal to 300 mm and its maximum diameter is less than or equal to 5 mm. The injector 53 has a diameter that can be as large as 3 mm. The injector 53 has a length that is relatively short, so that it generates limited head losses.

The atomizer 1 also has a cleaning duct 16.1 that extends between the valve 100 and the atomizer means 5. The cleaning duct 16.1 is shown diagrammatically in dashed lines in FIGS. 1 and 2. The cleaning duct is connected to a first downstream segment 16.2 and to a second downstream segment 16.3. The first downstream segment 16.2 opens out towards the bell cup 51. The second downstream segment 16.3 opens out into the injector 53.

The cleaning duct 16.1 and then the downstream segments 16.2 and 16.3 channel the solvent towards and into the atomizer means 5, so as to clean or rinse the injector 53, and the surfaces of the bell cup 51. More precisely, the cleaning stage uses streams of compressed air and of solvent to remove paint deposited on the soiled surfaces.

The valve 100 is particularly compact. The length $L_{13}$ of the duct 13 is relatively short, thereby making it possible to minimize wastage of paint and consumption of solvent during the stages of cleaning and of re-supplying the reservoir 10.

A method of re-supplying the atomizer 1 with coating material, e.g. with paint, consists firstly in a step in which all of any paint remaining in the reservoir 10 is dumped. Any such residual paint is dumped through the second feed duct 4 and through the bell cup 51.

Then, the valve 100 is opened in order to cause all of the solvent to flow into the reservoir 10, into the cleaning duct 16.1, and into the downstream segments 16.2 and 16.3, and, downstream from the reservoir 10, through the bell cup 51, where it can be collected. Then, the valve 100 is opened in order to cause paint to flow into the connection duct 13, so as to fill the reservoir 10 with paint of a new shade of color. In other words, the atomizer 1 can be free of any circuit for collecting waste paint and waste solvent.

In addition, the height $H_1$ of the atomizer 1, as measured in the spraying direction $Y_{50}$, is about 390 mm. In practice, the height $H_1$ of the atomizer 1 is selected to be less than 450 mm, and preferably to be less than 400 mm.

Such a height $H_1$ makes it easier for the atomizer 1 and for the robot 2 to access and to be removed from regions that are difficult to access, which is important because the minimum distance between the bell cup 51 and the article to be coated is about 200 mm during electrostatic spraying. Thus, the arrangement of the reservoir 10, with its main axis $X_{10}$ not parallel to the spraying direction $Y_{50}$ imparts good compactness to the atomizer 1, and thus excellent agility to the robot 2. The term "agility" is used to mean the aptitude of the atomizer 1 or of the robot 2 to reach regions that are difficult to access, in particular on the inside of a vehicle body.

For equivalent weight, the center of gravity $G_1$ of the atomizer 1 is positioned closer to the terminal axis $Y_{19}$ than the center of gravity of a prior art atomizer. The center of gravity $G_1$ shown in FIG. 1 is the center of gravity of the atomizer 1 when the reservoir 10 is full, as it is during the spraying stage. The center of gravity as empty is relatively close to the center of gravity $G_1$ because the weight of paint contained in the reservoir 10 is negligible compared with the weight of the atomizer 1.

The distance $H_{19}$ between the center of gravity $G_1$ and the terminal axis $Y_{19}$ is about 10 mm. The distance $H_{19}$ is measured "by the shortest route", i.e. perpendicular to the terminal axis $Y_{19}$. In practice, said distance $H_{19}$ is selected to be less than 80 mm, and preferably less than 20 mm. The center of gravity of a prior art atomizer is generally situated more than 100 mm away from the terminal axis.

Such a position for the center of gravity $G_1$, with such a distance $H_{19}$ makes it possible to minimize the moments of inertia of the atomizer 1 about the terminal axis $Y_{19}$.

It is thus possible to limit the forces that the robot 2 is required to generate, thereby allowing it to move with higher acceleration than a robot equipped with a prior art atomizer.

The invention claimed is:

1. An atomizer for spraying a coating material towards articles to be coated, the atomizer comprises:

a body equipped with a flange for fastening the atomizer to a robot, the robot and/or the flange defining a terminal axis about which the atomizer is designed to move relative to the articles to be coated;

a coating material reservoir housed in a proximal portion of the body and extending along a main axis; and atomizer means for spraying the coating material, the atomizer means are disposed in a distal portion of the body, the atomizer means having a bell cup atomizer member that rotates about an axis $Y_{51}$ superimposed with a spraying direction $Y_{50}$; wherein the spraying direction $Y_{50}$ is oriented from the bell cup toward the article to be coated;

the spraying direction $Y_{50}$ and the main axis $X_{10}$ of the reservoir are convergent on the body of the atomizer;

the angle between the main axis of the reservoir and the spraying direction lies in the range 50° to 100°, and the terminal axis $Y_{19}$ forms an angle with the spraying direction that lies in the range 110° to 130°; on a side of the spraying direction $Y_{50}$ oriented towards the flange and on a side of the terminal axis oriented toward the bell cup atomizer member.

2. An atomizer according to claim 1, wherein the distance between the center of gravity of the atomizer and the terminal axis is selected to be less than 80 mm.

3. An atomizer according to claim 2, wherein the atomizer also has a valve for controlling the flow of coating material and of a cleaning material through the atomizer, the valve forming a portion of the connection duct.

4. The atomizer of claim 2, wherein the distance between the center of gravity of the atomizer and the terminal axis is selected to be less than 20 millimeters.

5. An atomizer according to claim 1, wherein the height of the atomizer, as measured in the spraying direction is selected to be less than 450 mm.

6. A method of re-supplying an atomizer according to claim 5 with coating material, wherein said method comprises the following steps:

a) dumping all of any coating material remaining in the reservoir through the feed duct and through the atomizer member;

b) opening the valve to cause cleaning material to flow into the reservoir and into a cleaning duct, all of the cleaning material flowing, downstream from the reservoir, through the atomizer member; and c) opening the valve to cause the coating material to flow into the connection duct in such a manner as to fill the reservoir with the new coating material.

7. The atomizer of claim 5, the height of the atomizer, as measured in the spraying direction is selected to be less than 400 millimeters.

8. An atomizer according to claim 1, wherein the atomizer has at least one orifice for connection to a coating material circuit, said orifice being situated on a docking surface of the atomizer, and wherein it has a connection duct connecting the orifice to the reservoir, the connection duct having a length less than or equal to 50 mm.

9. An atomizer according to claim 1, wherein the atomizer means have a feed duct for feeding the atomizer member, the feed duct extending from the reservoir to the atomizer member, the feed duct having a length less than or equal to 300 mm, and a maximum diameter less than or equal to 5 mm.

10. The atomizer of claim 9, wherein the feed duct extending from the reservoir to the atomizer member has a maximum diameter of less than or equal to 4 millimeters.

11. An atomizer according to claim 1, wherein the reservoir has a piston for pushing the coating material towards the atomizer means, and wherein the atomizer also has an actuator for moving the piston along the main axis, the actuator being housed in the body between the reservoir and the flange.

12. An atomizer according to claim 1, wherein the reservoir is in the shape of a cylinder having a circular base and of volume laying in the range 200 $cm^3$ to 1000 $cm^3$, and the diameter of the cylinder of the reservoir lies in the range 50 mm to 120 mm.

13. The atomizer of claim 12, wherein the diameter of the cylinder of the reservoir is 100 millimeters.

14. An atomizer according to claim 1, wherein the atomizer means have rotary drive means for driving the atomizer member in rotation about an axis of rotation that substantially coincides with the spraying direction.

15. The atomizer of claim 1, wherein the angle between the main axis of the reservoir and the spraying direction is about 90°.

16. The atomizer of claim 1, wherein the terminal axis forms an angle with the spraying direction that is about 120°.

* * * * *